United States Patent [19]

Magnani

[11] Patent Number: 5,044,436

[45] Date of Patent: Sep. 3, 1991

[54] STEAM INJECTION PROFILING WITH UNSTABLE RADIOACTIVE ISOTOPES

[75] Inventor: Charles F. Magnani, Placentia, Calif.

[73] Assignee: Chevron Research and Technology Company, San Francisco, Calif.

[21] Appl. No.: 572,832

[22] Filed: Aug. 24, 1990

[51] Int. Cl.[5] ..... E21B 43/00

[52] U.S. Cl. ..... 166/247; 166/250; 166/272; 166/303; 73/154; 73/155

[58] Field of Search ..... 73/154, 155; 166/254, 166/247, 250, 303, 272

[56] References Cited

U.S. PATENT DOCUMENTS

| | | | |
|---|---|---|---|
| 3,435,672 | 4/1969 | Tenbrink et al. | 73/155 |
| 4,223,727 | 9/1980 | Sustek, Jr. et al. | 73/155 |
| 4,433,573 | 2/1984 | Hulin | 73/155 |
| 4,507,552 | 3/1985 | Roesner et al. | 250/259 |
| 4,793,414 | 12/1988 | Nguyen et al. | 166/303 |
| 4,817,713 | 4/1989 | Nguyen et al. | 166/272 |
| 4,861,986 | 8/1989 | Arnold | 73/155 |
| 4,958,684 | 9/1990 | Nguyen et al. | 166/272 |

*Primary Examiner*—Ramon S. Britts
*Assistant Examiner*—Roger J. Schoeppel
*Attorney, Agent, or Firm*—Edward J. Keeling; Matt W. Carson

[57] ABSTRACT

A method of determining relative liquid and vapor phase steam profiles in a steam injection well utilizes an unstable radioactive isotope. A dual detector gamma ray logging tool is inserted into the well at a depth below the perforation zone. The unstable radioactive isotope is then injected into the steam flow, and it naturally hydrolyzes from a vapor phase into a liquid phase at a known rate, so that at a given time after injection, the relative proportions of the vapor phase and the liquid phase can be determined. The transmit times of the vapor and liquid phases to pass between the gamma ray detectors is measured and the above steps are then repeated at a second location. The amount of fluid entering a formation between the first and second locations can then be determined.

6 Claims, 6 Drawing Sheets

DUAL DETECTOR TIME DRIVE RECORDING

CONVENTIONAL STEAM TRACER SURVEY

METHYL IODIDE FRACTION IN VAPOR DURING HYDROLYSIS $CH_3I + H_2O \rightarrow CH_3OH + HI$ GAMMA RAY OUTPUT USING $CH_3I$ TRACER
STEAM INJECTION: DEPTH 400 ft

UNSTABLE RADIOACTIVE ISOTOPE TRACER RESPONSE

GAMMA RAY DETECTOR OUTPUTS,
METHYL IODIDE SURVEY

STEAM INJECTION PROFILING WITH UNSTABLE RADIOACTIVE ISOTOPES

FIELD OF THE INVENTION

This invention relates generally to thermally enhanced oil recovery. More specifically, this invention provides a method and apparatus for accurately developing steam injection profiles in steam injection wells.

BACKGROUND OF THE INVENTION

In the production of crude oil, it is frequently found that the crude oil is sufficiently viscous to require the injection of steam into the petroleum reservoir. Ideally, the petroleum reservoir would be completely homogeneous and the steam would enter all portions of the reservoir evenly. However, it is often found that this does not occur. Instead, steam selectively enters a small portion of the reservoir while effectively bypassing other portions of the reservoir. Eventually, "steam breakthrough" occurs and most of the steam flows directly from an injection well to a production well, bypassing a large part of the petroleum reservoir.

It is possible to overcome this problem with various remedial measures, e.g., by plugging off certain portions of the injection well. For example, see U.S. Pat. Nos. 4,470,462 and 4,501,329, assigned to the assignee of the present invention. However, to institute these remedial measures, it is necessary to determine which portions of the reservoir are selectively receiving the injected steam. This is often a difficult problem.

Various methods have been proposed for determining how injected steam is being distributed in the wellbore. Bookout ("Injection Profiles During Steam Injection," SPE Paper No. 801-43C, May 3, 1967) summarizes some of the known methods for determining steam injection profiles and is incorporated herein by reference for all purposes.

The first and most widely used of the these methods is known as a "spinner survey." A tool containing a freely rotating impeller is placed in the wellbore. As steam passes the impeller, it rotates at a rate which depends on the velocity of the steam. The rotation of the impeller is translated into an electrical signal which is transmitted up the logging cable to the surface where it is recorded on a strip chart or other recording device.

As is well known to those skilled in the art, these spinners are greatly affected by the quality of the steam injected into the well, leading to unreliable results or results which cannot be interpreted in any way.

Radioactive tracer surveys are also used in many situations. With this method methyl iodide ($CH_3I$) has been used to trace the vapor phase. Sodium iodide has been used to trace the liquid phase. Radioactive iodine is injected into the steam, and the tracer travels down the well in the steam until it enters the formation. A typical gamma ray survey is run during the tracer injection. Recorded gamma ray intensity curves at any point in the well are then analyzed and the steam velocity is directly calculated.

U.S. Pat. No. 4,223,727 to Sustek discloses a method of estimating injectivity in an injection well by measuring volume of fluid injected with surface metering equipment and radioactive tracers to find injection depth. Both methyl iodine and Krypton 85 are mentioned as being suitable gaseous phase tracers.

U.S. Pat. No. 4,507,552 to Roesner describes a tool for injecting and detecting tracers in an injection well.

Use of dual detectors for velocity measurement is mentioned.

A written document entitled "*Surveying Steam Injection Wells Using Production Logging Instrument*" by Davarzani and Roesner, and carrying on it a date of August 1985 describes the device of U.S. Pat. No. 4,507,552 above. The choice of radioactive tracer is not specified. Applicant believes the authors presented the paper at a geothermal conference in Hawaii in August 1985 and the paper was available in a library in January 1986.

The vapor phase tracers have variously been described as alkyl halides (methyl iodide, methyl bromide, and ethyl bromide) or elemental iodine. Although it has previously been believed that these alkyl halide vapor tracers were not subject to decomposition in the short time periods involved, it has been previously noted that the above materials undergo chemical reactions that dramatically affect the accuracy of the results of the survey in steam injection profiling as described in related application Ser. No. 935,662 (allowance granted but not yet issued).

A method of steam injection profiling with inert gas tracers that teaches away from unstable alkyl halide tracers is described in related application Ser: No. 322,582, which is hereby incorporated by reference, and is assigned to applicant's assignee. Two tracers are required: an inert gas tracer and a liquid soluble tracer. Although use of inert gas tracers eliminates the hydrolysis problem created when methyl iodide is used, inert gas tracers are costly, low intensity, and have long half-lives. In many cases, using two separate tracers creates problems when flow is unstable. Two tracer surveys are required, which increases cost and time, and the results are often not additive.

Historically, high bottomhole temperatures encountered during steam injection prohibit using traditional logging sondes. As a result, steam profiling is 5–10 years behind traditional production logging technology. Consequently, accurate measurement of steam profiles is quite difficult, if not impossible.

There is therefore still a need for an improved, more accurate, less expensive, and simpler method to determine steam vapor and liquid profiles.

SUMMARY OF THE INVENTION

A method of determining relative liquid and vapor phase steam profiles in a steam injection well is described. The method generally comprises the steps of inserting a well logging tool into a steam injection well at a first location, said logging tool further comprising a first gamma ray detector, said first location below said perforated zone and above said tubing tail; inserting a second gamma ray detector in communication with steam upstream of said first gamma ray detector, injecting an unstable radioactive isotope into the steam injection well, which naturally hydrolyzes from a vapor phase into a liquid phase at a known rate, so that at a given time after injection, the relative proportions of the vapor phase and the liquid phase can be determined, measuring a transit time of the vapor phase isotope and the liquid phase isotope to pass between the first and the second gamma ray detector; moving the logging tool to a second location; repeating the above steps at a second location; and calculating an amount of fluid entering a formation between the first and the second locations.

DETAILED DESCRIPTION OF THE INVENTION

The proposed invention improves the accuracy of production logging in steam injection wells. The invention provides a simple, inexpensive method to directly determine the wellbore velocity of both steam vapor and liquid phases using a single radioactive tracer logging method: specifically unstable radioactive isotopes, such as methyl iodide, hydrolyze.

Figure 1:
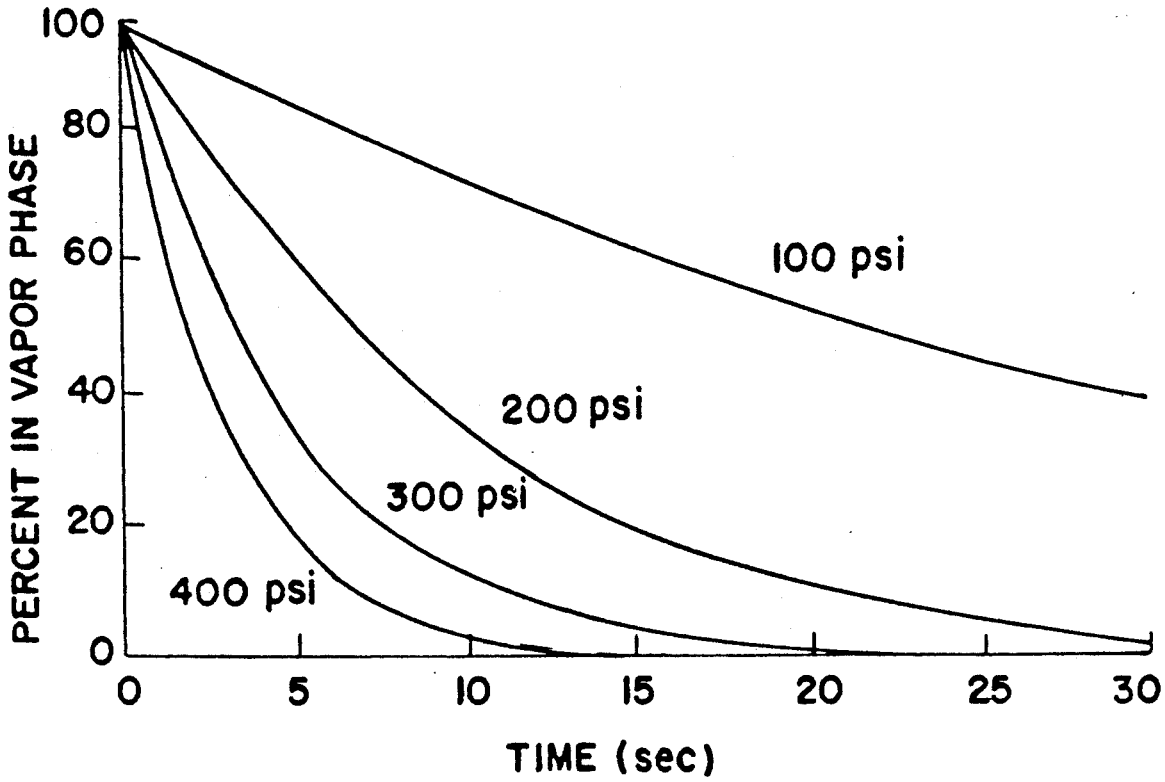
FIG. 1 is a plot showing the fraction of methyl iodide remaining in the vapor phase as a function of pressure and time.

When methyl iodide is injected into a steam injection well it hydrolyzes at a rate dependent upon well temperature and pressure. The fraction of methyl iodide remaining in the vapor phase, as a function of time and pressure, is shown in FIG. 1. This hydrolization permits the velocity of both liquid and vapor phases to be measured at any point along the wellbore. Properly selected unstable radioactive isotopes also indicate slip velocity; i.e., the difference between the vapor and liquid phase velocity. The phase velocities are used to determine the amount of each phase injected into target layers or zones of a reservoir. Resulting steam profiles must be accurate, to determine zonal injection distribution and to monitor the progress of steam floods.

The inventive method makes use of unstable radioactive isotopes such as methyl iodide to determine both liquid and vapor phase velocity during steam injection.

It has been observed that when methyl iodide hydrolyzes, the tracer partitions between both liquid and vapor phases. This "partition" is detectable using single or dual gamma ray detectors. Under proper flow conditions two distinct peaks can be detected: the first peak indicates vapor while the second peak indicates liquid. When a dual gamma detector is used, the difference in transit time can advantageously be used to determine vapor and liquid phase velocity. Only one tracer is used to simultaneously measure the wellbore phase velocity of both the vapor and the liquid.

When an alkyl halide tracer is used to define a steam injection profile, poor profiles generally result. This is because alkyl halides are unstable when in contact with high temperature water. At high temperatures, the alkyl halides hydrolyze and begin to trace the water phase.

Methyl iodide and other alkyl halide tracers degrade according to the following reactions in a steam injection well within the time required for the tracers to reach the formation:

Methyl iodide: $CH_3I + H_2O \longrightarrow CH_3OH + HI$

Ethyl iodide: $C_2H_5I + H_2O \longrightarrow C_2H_5OH + HI$

-continued (with a possible side reaction: $C_2H_5I \longrightarrow C_2H_4 + HI$)

Methyl bromide: $CH_3Br + H_2O \longrightarrow CH_3OH + HBr$

Ethyl bromide: $C_2H_5Br + H_2O \longrightarrow C_2H_5OH + HBr$

Due to the high solubility and low vapor pressure of HI and HBr, the reaction products will virtually totally equilibrate into the liquid phase of the steam. Also, HI and HBr are strong acids while the liquid phase of the steam is very basic, so once the HI or HBr equilibrates into the liquid phase, they will be converted to salts which are totally water-soluble. Therefore, when a portion of an alkyl halide vapor phase tracer thermally degrades (hydrolyzes) within the wellbore, the liquid phase of the steam will also be traced.

As methyl iodide travels from the wellhead to the formation, liquid soluble HI forms, resulting in a smaller fraction of methyl iodide in the vapor phase. However, the reaction is not instantaneous and is time dependent. Herein lies the advantage of using a properly tailored unstable radioactive isotope to profile steam injection wells.

FIG. 1 illustrates the fraction of methyl iodide remaining in the vapor phase as a function of pressure and time. It is clear from FIG. 1 that a substantial amount of vapor phase tracer remains depending on the time duration and bottomhole pressure. This implies that both liquid and vapor phases can be tracked using a single unstable radioactive isotope. Different isotopes can be selected for the specific bottomhole conditions and required logging times.

Figure 2:
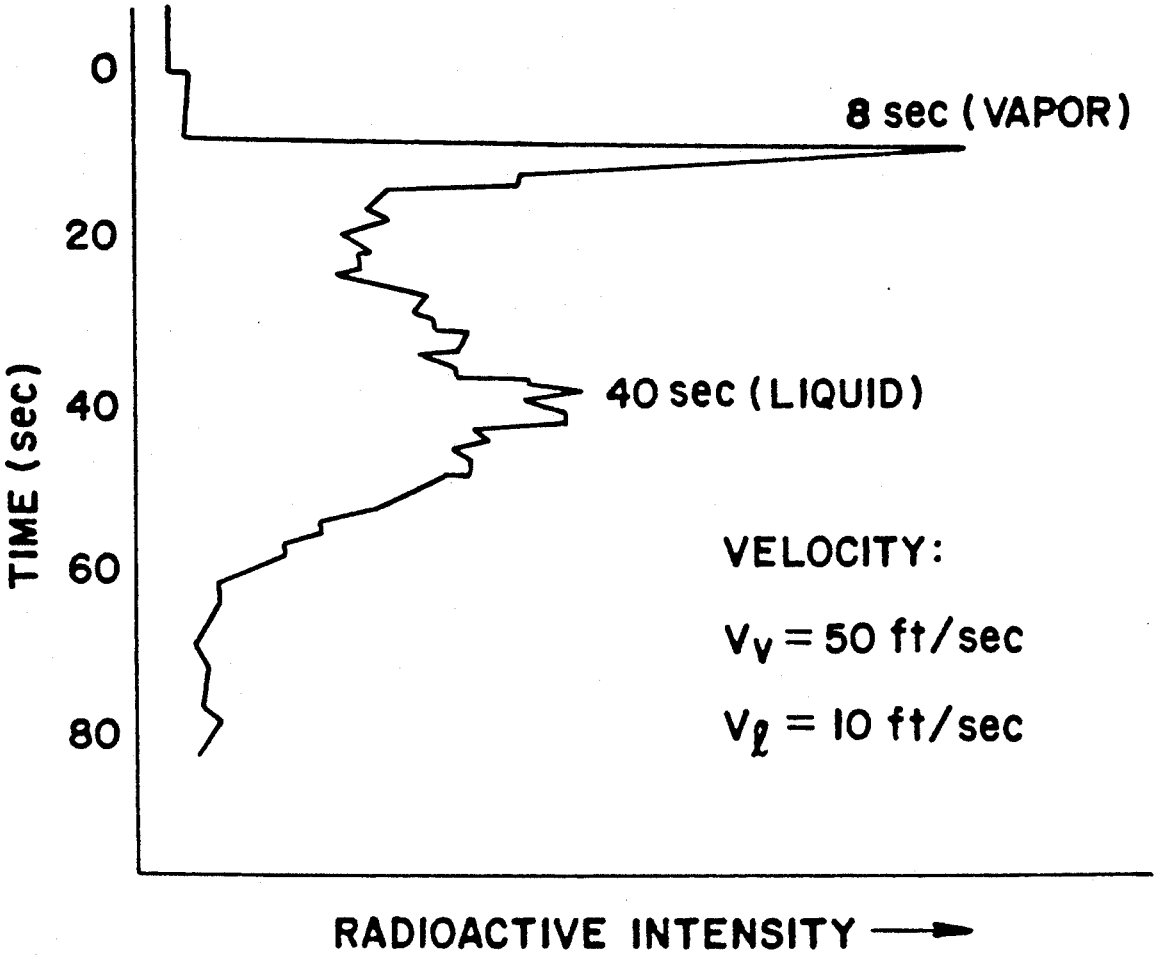
FIG. 2 illustrates methyl iodide injection gamma ray output as a function of time.

FIG. 2 illustrates dual peaks observed during steam profiling using methyl iodide when the bottomhole injection when pressure is 300 psi. Two peaks are observed: a vapor peak and a liquid peak. Both peaks are used to calculate the velocity of liquid and vapor phases. The unstable radioactive isotope must dissociate or hydrolyze slowly enough to permit tracking of both phases. However, from FIG. 1 it is clear that both vapor and liquid phases are being tracked.

Figure 3:
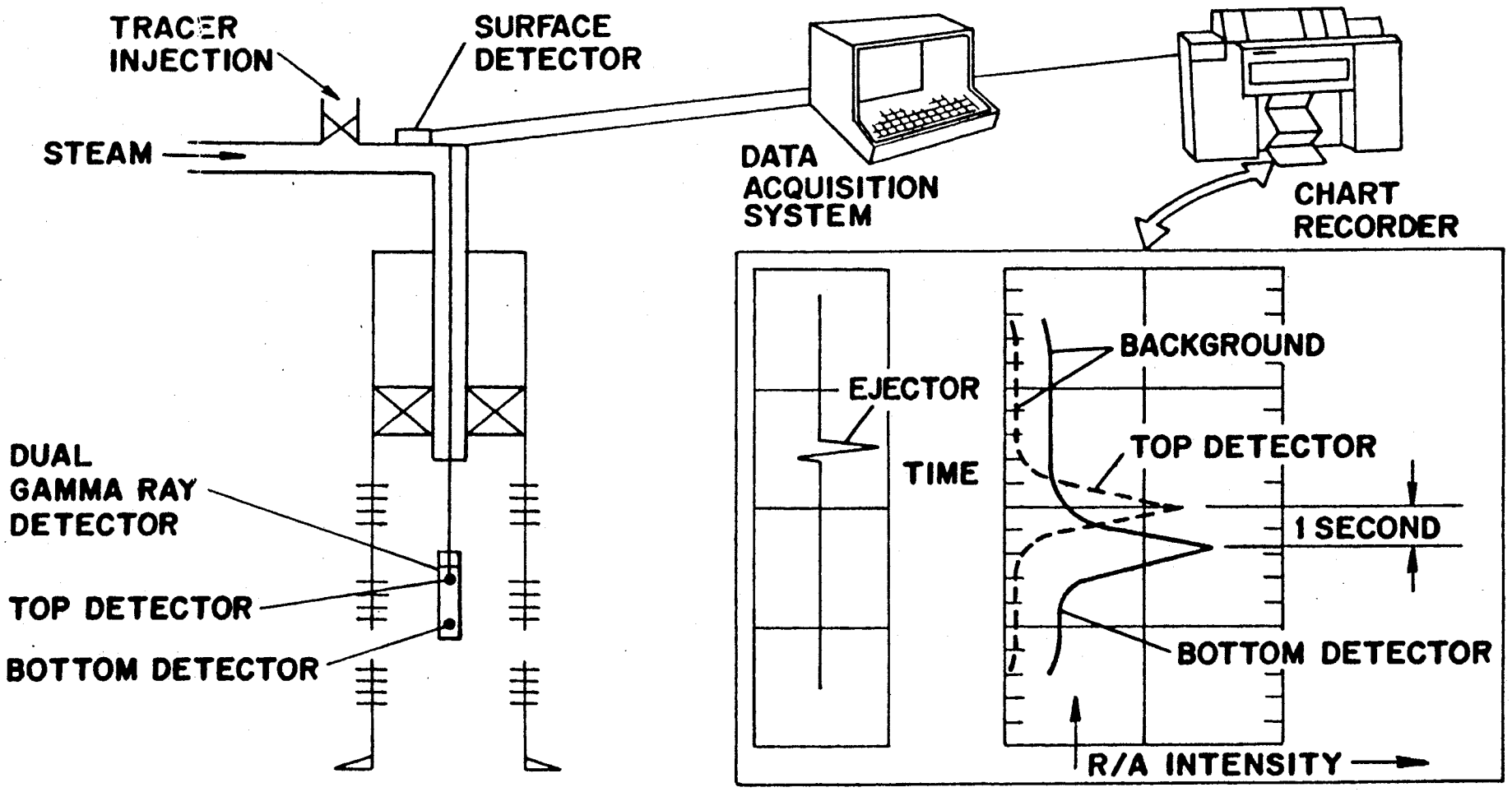
FIG. 3 schematically illustrates a tracer log survey apparatus and, a method of performing profiles.

FIG. 3 is a schematic diagram illustrating a conventional steam tracer log and survey apparatus. The key component is the dual gamma ray detector. Using the dual gamma ray detector, the transit times for first vapor and then liquid could be measured. If the distance between detectors is known, the phase velocities can be calculated.

Figure 4:
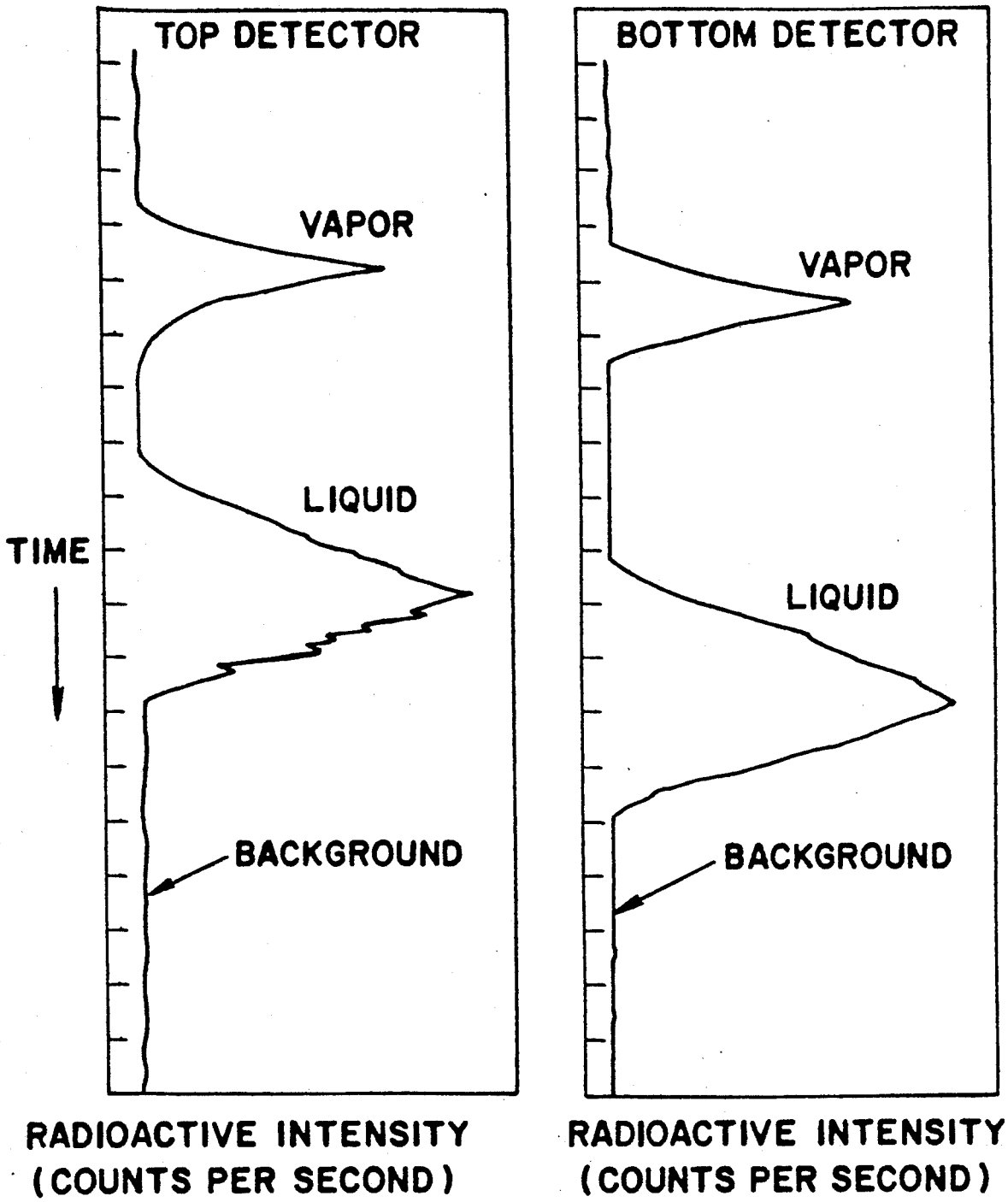
FIG. 4 shows the response curves for an unstable radioactive isotope tracer.

In contrast to FIG. 3, FIG. 4 illustrates a typical tracer response curve when an unstable radioactive isotope such as methyl iodide is injected. As shown, four distinct peaks are recorded from the injection of one tracer shot, rather than merely two as with conventional tracer methods. Since the vapor velocity is greater than the liquid velocity, the vapor phase and thus the vapor phase tracer peak appears first at both detectors. Since the velocity of vapor and liquid are different, a spectral gamma ray tool is not required. Transit time is sufficient to identify the phase that is flowing.

Figure 5:
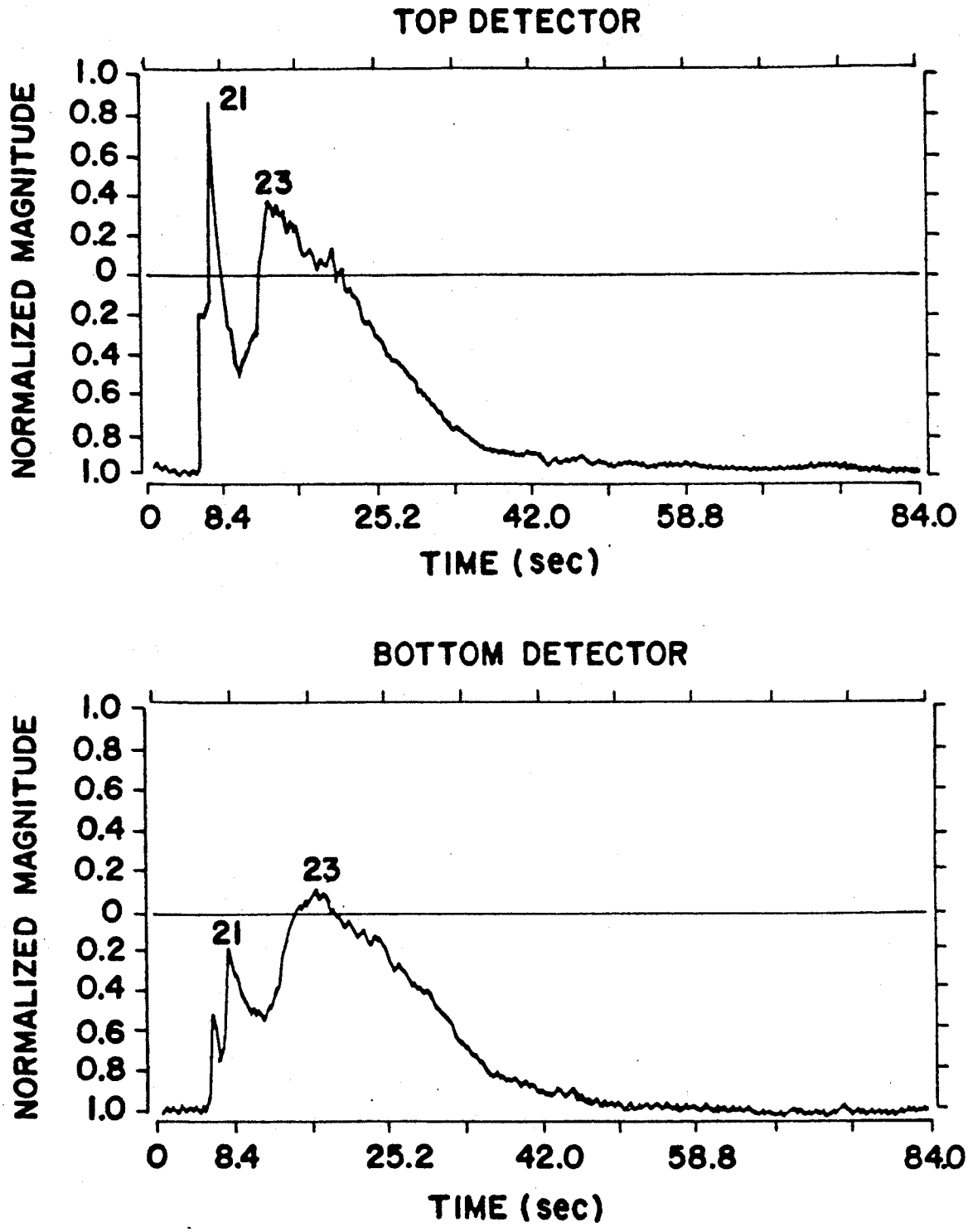
FIG. 5 shows a typical methyl iodide signal.

FIG. 5 (after Nguyen, U.S. Pat. No. 4,793,414, Figure No. 1) illustrates methyl iodide tracer response monitored using a dual gamma ray detector. The transit time is determined for the vapor (first peak) 21 and the liquid (second peak) 23. Methyl iodide traces the vapor phase at the first peak 21, and breakdown products follow the liquid phase at the second peak 23. When the isotope is properly selected, a single sharp peak should be discerned for each phase. Numerous unstable isotopes are available to increase or decrease the reaction time as warranted. Isotope concentrations can also be increased at the surface to amplify the downhole signals.

Figure 6:
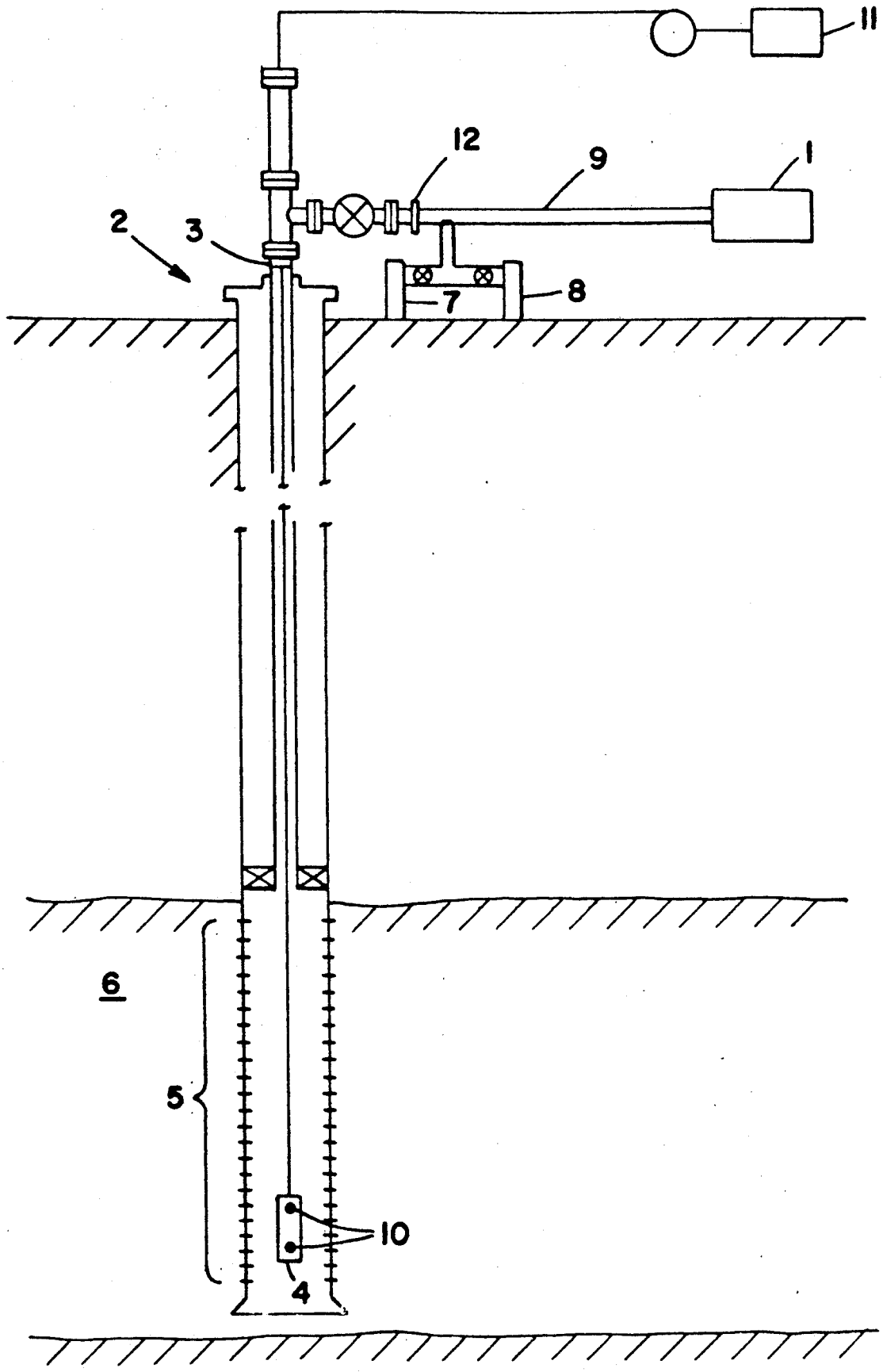
FIG. 6 schematically illustrates a tracer log survey apparatus and method used when the tubing tail is above the perforated zone of the well.

Therefore, an improved method and means of determining the steam injection profile (or steam profile) of a steam injection well has been devised. FIG. 6 schematically illustrates the method and apparatus used when the tubing tail is above the perforated zone of the well. Steam is generated in steam generator 1 and injected into steam injection well 2 through tubing 3 and perforations 5 into petroleum formation 6. It is important in the practice of the present invention that the steam rate and quality be maintained at a relatively constant level, so conditions should be stabilized before the method is carried out. The steam mass flow rate (and, optionally, quality) is determined at the wellhead with measurement equipment 12 and should be measured before, during, and after logging the steam injection well.

Initially, a well logging tool 4 is used to develop temperature and/or pressure profiles which enable the determination of vapor and liquid densities from steam tables. Well logging tool 4 is then returned to the bottom of perforated zone 5.

Logging tool 4 is of a type well known in the art and contains gamma ray detectors 10. Instrumentation and recording equipment 11 is used to record the transit time for the passing slug of tracer between the detectors 10.

An unstable radioactive isotope 7 is then injected into the well at a location on the steam line 9. The isotope is of a type which naturally hydrolyzes from a vapor phase into a liquid phase at a known rate, so that at a given time after the isotope injection, the relative proportions of the vapor phase and the liquid phase can be determined.

The transit time of the vapor phase isotope and the liquid phase isotope to pass between the gamma ray detectors 10 is then measured. The logging tool 4 is then moved to a second location in the well 2, and another injection of said unstable isotope is performed and more transit times are measured in the same fashion as described above.

The vapor phase and liquid phase velocities are then calculated, based on the elapsed time required for the vapor and liquid phase isotopes to pass between the two gamma ray detectors 10. The amount of vapor and liquid entering a geologic formation between the first and second locations can then be calculated, based on the mass flow rate of the steam entering the well, the liquid transit times, and the vapor transit times. Relative liquid and vapor steam injection profiles can therefore be determined.

In the preferred embodiment, the unstable radioactive tracer is selected from various alkyl halides. A sufficient quantity is injected to permit easy detection at the gamma ray detectors. The quantity will vary radically depending on steam flow rate and steam quality, but can be readily calculated by one skilled in the art.

In another embodiment, the radioactive tracer is stable; however the carrier fluid is unstable. Elemental iodine when injected with a carrier fluid such as water will trace both liquid and vapor during steam injection. When a carrier fluid containing a radioactive isotope such as elemental iodine is injected into the steam flow stream at the wellhead, the carrier fluid vaporizes in proportions similar to the injected steam. Field experiments indicate that the tracer (such as iodine) is then transported in both the liquid and vapor phase.

The radioactive tracer transported in each phase is detected using dual gamma ray detectors. The observed response is identical to the response shown in FIG. 4: The vapor peak appears first and the liquid peak appears second. Both vapor and liquid velocities can be determined using the transit time for each phase to pass between the gamma ray detectors.

The carrier fluid should be selected to match the properties of the injected fluid such as density, solubility, composition, and salinity. This will improve phase tracking. Numerous carrier fluids can be used, however water has been found to be the most useful carrier for steam injection.

In another embodiment, a second gamma ray detector is inserted in the well in communication with the steam, and upstream of the first gamma ray detector, which is inserted at a location above the tubing tail.

In still another embodiment, the steam injection well has an annulus and a perforated zone above a tubing tail. A well logging tool comprising dual gamma ray detectors separated by a specified distance is inserted into the steam injection well to a first location which is below the perforated zone and above the tubing tail. The same type of unstable radioactive isotope described above is utilized. The transit time of the vapor phase and the liquid phase isotopes to pass between the first and second gamma ray detectors is measured. After the logging tool is moved to a second location in the well, the above steps are repeated, and the amount of fluid entering a formation between the first and second location is then calculated.

The vapor and liquid flow rates at each location in the perforated zone can be determined respectively with the equations:

$$V_V = \frac{L}{T_V} \tag{1}$$

$$V_L = \frac{L}{T_L} \tag{2}$$

where $V_V$=Vapor velocity;

$V_L$=Liquid velocity;

L=The distance between detectors 10;

$T_V$=Vapor transit time; and $T_L$=Liquid transit time.

From a simple mass balance, it is also found that:

$$W=[\rho_V \alpha V_V+\rho_L(1-\alpha)V_L]A \tag{3}$$

where:

W=The mass flow rate measured at each tool location;

A=The wellbore cross-sectional area corrected for the presence of the logging tool;

$P_V$ and $\rho_L$=The vapor and liquid phase densities (determined from the temperature logs, the pressure logs, or from both); and $\alpha$=The downhole void fraction Solving for $\alpha$ from Equation (3) yields:

$$\alpha = \frac{\frac{W}{A} - \rho_L V_L}{\rho_V V_V - \rho_L V_L} \quad (4)$$

The downhole steam quality above the top perforated zone, i.e., at the tubing tail, can then be calculated from the equation:

$$x = \frac{\rho_V \alpha V_V}{\rho_V \alpha V_V + \rho_L (1-\alpha) V_L} \quad (5)$$

where:

x=Steam quality at the top of the perforated zone.

Beginning at the top of the perforations, the vapor and liquid profiles can now be determined. Since the total mass flow rate into the well is known, the vapor and liquid flow rates at the top of the perforated interval (designated station "1") can be calculated from the equations:

$$W_{V1} = (W)(x) \quad (6)$$
$$W_{L1} = (W)(1-x) \quad (7)$$

where:

$W_{V1}$=The vapor mass flow rate at station 1.

$W_{L2}$=The liquid mass flow rate at station 1.

The amount of vapor and liquid leaving the wellbore between station 1 and station 2 is now given by the equations:

$$W_{WV1} = W_{V1}\, 1 - \frac{\alpha_2}{\alpha_1} \quad \frac{T_{V1}}{T_{V2}} \quad (8)$$

$$W_{WL1} = W_{L1}\, 1 - \frac{(1-\alpha_2)}{(1-\alpha_1)} \quad \frac{T_{L1}}{T_{L2}} \quad (9)$$

The vapor and liquid mass flow rates at station 2 are now given by the equations:

$$W_{V2} = W_{V1} - W_{WV1}$$
$$W_{L2} = W_{L1} - W_{WL1}$$

The above calculations can now be performed at every location in the wellbore where data have been taken. In general, the amount of vapor and liquid entering the formation between station i and station (i+1) will be given by the equations:

$$W_{WVi} = W_{Vi}\left[1 - \left(\frac{\alpha_{i+1}}{\alpha_i}\right)\left(\frac{T_{Vi}}{T_{V(i+1)}}\right)\right] \quad (10)$$

$$W_{WLi} = W_{Li}\left[1 - \left(\frac{1-\alpha_{(i+1)}}{(1-\alpha_i)}\right)\left(\frac{T_{Li}}{T_{L(i+1)}}\right)\right] \quad (11)$$

The above-described method is useful when the perforated interval(s) lie below the tubing tail. However, it is necessary to make adjustments known in the art to the method when the perforated interval(s) are above the tubing tail. Note that in some situations the pressure and temperature of the steam along the tubing may vary sufficiently that the velocity will vary over the length of the tubing. In that case, the velocity can readily be calculated along differential sections of tubing, or one could, preferably, locate the detector at various locations along the tubing to determine tubing velocity at various points.

The velocity of the liquid and vapor are now determined in the annulus ($V_A$) with the equations:

$$V_{AL} = \frac{h_A}{\left[\Delta t_{2L} - h_A\left(\frac{1}{V_{TL}}\right)\right]} \quad (15)$$

$$V_{AV} = \frac{h_a}{\left[\Delta t_{2V} - h_A\left(\frac{1}{V_{TV}}\right)\right]} \quad (16)$$

wherein $h_A$=the distance from the downhole gamma ray tool to the tubing tail;

$\Delta t_2$=The elapsed time from the slug passing the downhole tool at the first station on the downward pass until it passes the tool on the upward pass.

The annular void fraction at station 1 ($\alpha_{A1}$) is now calculated from the equation:

$$\alpha_{AL} = \frac{\frac{W}{A_A} - \rho_L V_{AL}}{\rho_V V_{AV} - \rho_L V_{AL}} \quad (17)$$

where:

$A_A$=Cross-sectional area of the annulus and the steam quality at the first station in the annulus is calculated from the equation:

$$x_{A1} = \frac{\rho_V \alpha_{A1} V_{AV}}{\rho_V \alpha_{A1} V_{AV} + \rho_L (1-\alpha_{A1}) V_{AL}} \quad (18)$$

The mass flow rate of liquid and vapor at station 1 can be calculated from the equations:

$$W_{V1} = W(X_{A1}) \quad (19)$$
$$W_{L1} = W)1 - X_{A1}) \quad (20)$$

The tool is moved to a higher location and the above process is repeated. In general, the annular velocity for either the liquid or vapor phase at a station "i" is given by the equation:

$$V_{Ai} = \frac{h_i - h_{(i-1)}}{\Delta_{ti} - \sum_{n=1}^{i}\left(\frac{h_n - h_{(n-1)}}{V_{ti}}\right) - \sum_{n=1}^{i-1}\left(\frac{h_n - h_{(n-1)}}{V_{an}}\right)} \quad (21)$$

where:

$h_i$=detector depth measured from same reference point $V_{Ai}$=average annular velocity between $h_i$ and $h_{i-1}$ $\Delta_{ti}$=the time between two pulses observed at the detector $V_{ti}$=tubing velocity at depth $h_i$.

The above equation can then readily be substituted into equations (17) and (18) to obtain x at any station. The amount of vapor and liquid entering the formation between stations i and (i+1) are then given from the equations:

$$W_{WVi} = W_{vi} - W_{v(i+1)} \quad (22)$$

$$W_{WLi} = W_{Li} - W_{L(i+1)} \quad (23)$$

Experiments demonstrate that complex multiphase flow regimes often exist in the annular cross-section, between the tubing and casing. The occurrence of these flow regimes is attributed to pressure and temperature drops that occur when steam changes flow direction from down-the-tubing to up-the-annulus. When steam quality is low, long liquid columns often occur in the annulus. The liquid column causes flow instability which often makes the tracer randomly disperse. In this case, a special tracer analysis method should be used as the transit time method is inappropriate.

The analysis procedure is called tracer loss and is detailed below.

TRACER LOSS METHOD

1. Locate the vapor-liquid interface in the annulus using a conventional thru-tubing temperature log survey. This procedure is well known to one skilled in the art.

2. Run a background gamma log survey to measure the baseline radiation level in the wellbore and the formation.

3. Lower the dual gamma ray detector to a depth just above the vapor-liquid interface. This depth represents the point where all the injected radioactive tracer will pass and is referred to as the 100% point or station 1.

4. Inject a high concentration (50 millicuries) of unstable radioactive isotope down the tubing at the surface.

5. Record all radioactive intensity using the dual gamma ray detectors. The radioactive intensity of interest is the intensity recorded as the tracer moves upward in the annulus. All radiation is recorded at a given depth for a sufficient period of time such that the radiation level returns to the background level determined in step 2.

6. Move the dual gamma ray detector up to the next station of interest. Repeat the procedure (steps 4 and 5) using the same concentration of tracer for all stations.

7. Calculate the cumulative gamma radiation detected at each station, above the background level, using the equation:

$$CG_m = \sum_{i=0}^{n} (G_i \Delta t_i) - (BG)_m \Delta T$$

where:

$G_i$=recorded gamma radiation in counts per second at the station $\Delta t_i$=the time interval during which the gamma ray counts are recorded (seconds)

m=station of interest $BG_m$=background gamma radiation in counts per second $\Delta T$=cumulative time the tracer gamma radiation is recorded (seconds)

n=number of time intervals the gamma radiation is summed over

CG=cumulative gamma radiation counts over the time interval $\Delta T$.

8. Calculate the percent of the bulk steam injection going into an interval using the equation.

$$\% \text{ injection} = \left( \frac{CG_m - CG_{m+1}}{CG_1} \right) 100$$

where $CG_m$ is the cumulative gamma radiation at the mth station. All injected volumes are referenced to the first station where 100% of the total injection occurs.

It should be noted in all of the above embodiments that it is not critical to know the exact mass flow rate of steam the well. If the mass flow rate into the well is not known, a significant amount of information can be derived simply by knowing the relative amounts of the two phases of steam entering the formation at various locations.

The invention described herein can be useful in applications beyond those discussed above. For example, the invention could find application when the tubing tail is within the perforations. This configuration would require that 100% flow be measured in the tubing. To calculate profile, all measured transit times are converted to equivalent transit times in a common flow area, such as casing. Profile calculations would otherwise be identical to that described above.

Downhole steam quality is a useful parameter and can also be determined from the above-described method for determining a total heat injection profile and overall heat loss. The wellhead steam flow rate, downhole pressure and vapor velocity are used to calculate downhole quality. Steam quality and flow rate are given by, for example, Equations 3 and 5. Even when liquid velocities are not available, void fraction and multiphase flow correlations can be used to determine quality.

Given the vapor and liquid phase profiles, downhole pressure, downhole quality, and total flow rate into the well, a total heat profile can also be calculated. The downhole quality and vapor phase profile can be obtained with an inert gas survey. The liquid phase profile can be obtained with a conventional sodium iodide survey. The fraction of heat entering each zone of interest is given by:

$$F = \frac{GH_v x + LH_l(1 - x)}{H_v x + H_l(1 - x)} \quad (24)$$

where:

F=Fraction of heat entering an interval

G=Fraction of vapor entering an interval $H_v$=Enthalpy of the vapor x=Quality at the interval L=Fraction of liquid entering an interval $H_l$=Enthalpy of the liquid.

Results of the field test conducted by T. V. Nguyen (U.S. Pat. No. 4,793,414) in June 1986 were reinterpreted in view of the proposed method. Table 1 briefly details the results. Methyl iodide tracer data shown on FIG. 5 were reanalyzed using the data from peaks 21 and 23. These peaks are most representative of vapor and liquid velocity. The transit times are compared with those obtained using krypton and Sodium Iodide. Results are in reasonable agreement despite the difference in measurement time and lack of attempt to include the liquid holdup in the calculations.

While a preferred embodiment of the invention has been described and illustrated, it should be apparent that many modifications can be made thereto without departing from the spirit or scope of the invention. Accordingly, the invention is not limited by the foregoing description, but is only limited by the scope of the claims appended hereto.

TABLE I

METHYL IODIDE SURVEY. TRANSIT TIME DATA

| | $CH_3I$ | | $Kr^{85}$ I-131 | |
|---|---|---|---|---|
| Depth ft | Vapor Transit Time at 21, sec | Liquid Transit Time at 23, sec | Transit Time of Krypton, sec | Transit Time of Sodium Iodide, sec |
| 560 | 0.6 | 3.8 | 0.42 | 2.76 |
| 570 | 0.86 | 2.7 | 0.54 | 3.26 |
| 575 | 0.68 | 3 | 0.82 | — |
| 580 | 0.78 | 3.64 | 0.86 | 3.12 |
| 585 | 0.84 | — | 0.76 | 2.92 |
| 590 | 0.92 | 3.02 | 0.90 | — |
| 595 | 0.48 | 2.78 | 0.94 | — |
| 626 | 0.98 | — | 1.02 | 4 |
| 640 | 0.92 | 6.6 | 1.4 | 5.04 |

What is claimed is:

1. A method of determining liquid and vapor phase profiles in a steam injection well comprising the steps of:

(a) inserting a well logging tool into a steam injection well at a first location, said logging tool further comprising dual gamma ray detectors separated by a specified distance;

(b) measuring a mass flow rate of steam entering the steam injection well, before, during, and after logging said steam injection well;

(c) injecting an unstable radioactive isotope into the steam injection well, said isotope being of a type which naturally hydrolyzes from a vapor phase into a liquid phase at a known rate, so that a given time after said isotope injection, the relative proportions of said vapor phase and said liquid phase can be determined;

(d) measuring the transit time of said vapor phase isotope and said liquid phase isotope to pass between said gamma ray detectors;

(e) moving said logging tool to a second location in said well;

(f) repeating steps (c), (d), and (e);

(g) calculating vapor phase and liquid phase velocities based on the elapsed time required for said vapor and liquid phase isotopes to pass between said two gamma detectors; and (h) calculating the amount of vapor and liquid entering a formation between said first location and said second location based on said mass flow rate of steam entering the well, said liquid transit times, and said vapor transit times.

2. The method as recited in claim 1 wherein said unstable radioactive isotope is selected from the groups alkyl halides and elemental iodine in various carrier fluids.

3. A method of determining steam profiles in a steam injection well comprising the steps of:

(a) inserting a well logging tool into a steam injection well at a first location, said logging tool further comprising a first gamma ray detector, said first location above a tubing tail;

(b) inserting a second gamma ray detector in communication with said steam upstream of said first gamma ray detector;

(c) injecting an unstable radioactive isotope in the steam injection well, said isotope being of a type which naturally hydrolyzes from a vapor phase into a liquid phase at a known rate, so that at a given time after said isotope injection, the relative proportions of said vapor phase and said liquid phase can be determined, said isotope selected from the groups alkyl halides and elemental iodine in various carrier fluids;

(d) measuring the transit time of said vapor phase isotope and said liquid phase isotope to pass between said first and said second gamma ray detectors;

(e) moving said logging tool to a second location in said well;

(f) repeating steps (c) and (d); and (g) calculating by use of said transit time, an amount of fluid entering a formation between said first location and said second location.

4. A method of determining relative liquid and vapor steam injection profiles in a steam injection well having an annulus and a perforated zone above a tubing tail comprising the steps of:

(a) inserting a well logging tool into said injection well at a first location, said logging tool further comprising dual gamma ray detectors separated by a specified distance, said first location being below said perforated zone and above said tubing tail;

(b) injecting an unstable radioactive isotope into said steam injection well, said isotope being of a type which naturally hydrolyzes from a vapor phase into a liquid at a known rate, so that at a given time after said isotope injection, the relative proportions of said vapor phase and said liquid phase can be determined;

(c) measuring the transit time of said vapor phase isotope and said liquid phase isotope to pass between said first and said second gamma ray detectors;

(d) moving said logging tool to a second location in said well;

(e) repeating steps (b), (c), and (e); and (f) calculating by use of said transit time, an amount of vapor and an amount of liquid entering a formation between said first location and said second location.

5. A method of determining steam profiles in a steam injection well having an annulus and a perforated zone above a tubing tail comprising the steps of:

(a) inserting a well logging tool into said steam injection well at a first location, said logging tool further comprising a first gamma ray detector, said first location above said tubing tail;

(b) inserting a second gamma ray detector in communication with said steam upstream of said first gamma ray detector;

(c) injecting an unstable radioactive isotope into said steam injection well, said isotope being of a type which naturally hydrolyzes from a vapor phase to a liquid phase at a known rate, so that at a given time after said isotope injection, the relative proportions of said vapor phase and said liquid phase can be determined;

(d) measuring the transit time of said vapor phase isotope and said liquid phase isotope from the time said isotopes pass said first detector until the time said isotopes pass said second detector;

(e) measuring the transit time from the time said isotopes pass said second detector in said tubing until the time said isotopes pass said second detector in said well annulus;

(f) moving said tool to a second location;

(g) repeating at least steps (c) and (e); and (h) calculating by use of said transit time, an amount of fluid entering a formation between said first and said second location.

6. Method as recited in claims 5 wherein said unstable isotope is selected from the groups alkyl halides and elemental iodine in various carrier fluids.

* * * * *